US006227684B1

(12) United States Patent
Wijbenga et al.

(10) Patent No.: US 6,227,684 B1
(45) Date of Patent: May 8, 2001

(54) LUMINAIRE

(75) Inventors: Hendrik Wijbenga; Jean P. Entrop, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/054,788

(22) Filed: Apr. 3, 1998

(30) Foreign Application Priority Data

Apr. 7, 1997 (EP) ..... 97201019

(51) Int. Cl.[7] ..... F21V 7/00

(52) U.S. Cl. ..... 362/310; 362/297; 362/301; 362/346

(58) Field of Search ..... 362/223, 297, 362/300, 301, 302, 346

(56) References Cited

U.S. PATENT DOCUMENTS 4,642,736 * 2/1987 Masuzawa et al. ..... 362/31
5,544,030 8/1996 Wijbenga ..... 362/297
5,564,820 10/1996 Entrop et al. ..... 362/362
5,645,344 * 7/1997 Wijbenga ..... 362/346

* cited by examiner

*Primary Examiner*—Sandra O'Shea
*Assistant Examiner*—Bertrand Zeade
(74) *Attorney, Agent, or Firm*—Norman N. Spain

(57) ABSTRACT

The luminaire has a concave reflector (1) with an optical axis (3) in a plane of symmetry (2), suitable to receive an elongate light source transverse to said plane (2). The reflector (1) is composed of flat facets (10,10') which are bounded by first parallel planes (8) which are transverse to the plane of symmetry (2), and which facets (10,10') are arranged in rows (11,11') by second planes (9) which are parallel to the plane of symmetry (2). The first planes (8) are at an acute angle to a light emission window (5). The reflector (1) touches the window (5) at one side of the axis (3) and is extended by a light reflecting screen (7) up to said window (5) at the opposite side of the axis (3). The luminaire can be used to illuminate sports fields, the light emission window (5) being directed downwards, has a sharp cut-off angle and prevents stray light above the horizontal.

16 Claims, 3 Drawing Sheets

LUMINAIRE

BACKGROUND OF THE INVENTION

The invention relates to a luminaire comprising:

a concave reflector with a plane of symmetry and an optical axis having an optical center lying in the plane;

a light emission window tangent to the reflector and transverse to the plane of symmetry;

holder for accommodating an electric lamp transversely to the plane of symmetry, with an elongate light source of the lamp in the optical center and;

a light-reflecting screen extending along the optical axis, transverse to the plane of symmetry; and reaching up to in the light emission window, the reflector comprises several plane facets which in their widths w are bounded by first, mutually substantially parallel, substantially flat planes perpendicular to the plane of symmetry, and which in addition in their lengths l are bounded by second substantially flat planes which arrange the facets into rows which extend along the plane of symmetry.

Such a luminaire is known from U.S. Pat. No. 5,544,030.

The known luminaire is not only symmetrical in the plane of symmetry, but substantially also in a plane perpendicular thereto and passing through the means for accommodating a lamp. The luminaire comprises a large number of mutually parallel second flat planes which bound the facets. The reflector is tangent to the light emission window around the optical axis, and the optical axis is perpendicular to the window. The luminaire is capable of concentrating light generated by an accommodated lamp into a substantially symmetrical light beam.

The luminaire may be positioned with its optical axis pointing obliquely downward. A screen is provided in the space defined by the reflector above the optical axis. The screen thus intercepts all light beams originating directly from the lamp which would be radiated in upward directions if the screen were absent.

The known luminaire is accordingly suitable for use inter alia in the illumination of grounds, for example sports grounds, because the luminaire counteracts the radiation of stray light, i.e. light not directed at the grounds to be illuminated. Irregularities in a transparent plate closing off the light emission window, however, or pollution on this late may nevertheless give rise to unpleasant stray light which is directed horizontally or upwards, as may light reflected by the plate towards the reflector.

SUMMARY OF THE INVENTION

It is an object of the invention to provide a luminaire which yields a comparatively wide light beam transverse to the plane of symmetry, while the radiation of unpleasant stray light is effectively counteracted.

According to the invention, the first substantially flat planes enclose an acute angle with the light emission window, and the screen extends from the reflector up to the light emission window.

The luminaire can be used for illuminating a horizontal surface with its light emission window in horizontal position, facing downwards, owing to its geometry with the reflector sloping down towards the light emission window. If the light emission window is closed off with a transparent plate, this plate can no longer cause any stray light in upward direction. Light reflected by the plate towards the reflector cannot do this either. The luminaire may even be used in the open condition, without a closing plate, if there is no risk of pollution by the environment.

The luminaire provides an asymmetrical beam, a beam which is narrow above the optical axis and wider below it in the above-mentioned position of the luminaire, and which may be comparatively wide transversely to the plane of symmetry, for example 2×35°. Seen from the lamp, the beam then has a light intensity at angles of 35° to the left and right of its center which is half that in the center. Nevertheless, the luminaire is compact in relation to the lamp to be accommodated. Its geometry avoids double reflections in the luminaire to a high degree and leads to a high efficiency. In spite of the comparatively wide beam to be realized, which renders possible the illumination of a comparatively large ground surface area, the luminaire is capable of realizing light beams with maximum intensities of 1000 up to 1600 cd/klm. A ground surface can be illuminated up to a comparatively long distance from the luminaire as a result in a homogeneous and efficient manner. Added to this, the screen provides a sharply defined cut-off angle, for example of approximately 15–25°, for example 25° to the horizontal plane. Stray light is avoided to a high degree within this cut-off angle, and is entirely absent above the horizontal plane.

The first flat planes may enclose an angle of, for example, 15–30°, for example 25° with the light emission window.

The reflector may reach up to in the light emission window with rows of facets on either side of the plane of symmetry. It is favorable, however, when side panels extend up to the screen on either side of the plane of symmetry, which panels extend to in the light emission window and bound facets of remote rows, i.e. rows lying farthest removed from the plane of symmetry. A gradual boundary of the light beam and a gradual light/dark transition of the illuminated field is obtained thereby.

The screen and the side panels may be, for example, diffusely reflecting. This leads to a lower luminance of said parts, and accordingly less glare when these parts are viewed. A portion of the screen adjoining the light emission window may have a white coating, for example be painted white. If a transparent plate closes off the light emission window, this paint can then prevent reflections on this plate and subsequently on the screen from causing local brightness differences in the illuminated field.

The side panels may be, for example, perpendicular to the light emission a window. They then provide a comparatively small spread to the light incident thereon and originating directly from the lamp. It is useful, however, for avoiding double reflections, for example from side panel to side panel, and for counteracting glare, when the side panels approach one another in a direction towards the screen. They may then each enclose an angle of, for example, 75 to 80° with the light emission window. It is also possible for the side panels to intersect the light emission window parallel to one another or to approach the reflector at an angle to one another which amounts to several degrees, for example 4 to 10, for example 6°.

A favorable light distribution in the beam is obtained in particular when the first flat planes have points of intersection with the reflector in the plane of symmetry which lie substantially on a parabola whose focus is the optical center. It is in addition favorable when the reflector has facets with a greater width w at a side of the optical axis reflected by the facets.

BRIEF DESCRIPTION OF THE DRAWINGS

To counteract reflections on the screen of light originating from the reflector, it is favorable when the screen and the optical axis diverge by an angle of a few degrees, for example 5°, towards the light emission window. In a special embodiment of this, the first planes are substantially parallel to the screen. It is achieved thereby that the maximum of the light beams formed will lie somewhat higher, for example by 2°, and the luminaire thus radiates farther.

The evenness of the illumination of an irradiated field may be enhanced in that the facet lying closest to the screen in the plane of symmetry is tilted inwards into the parabola along this screen. Light reflected by this facet is then added to the beam again at the side of the optical axis other than that where the screen is present.

Figure 1:
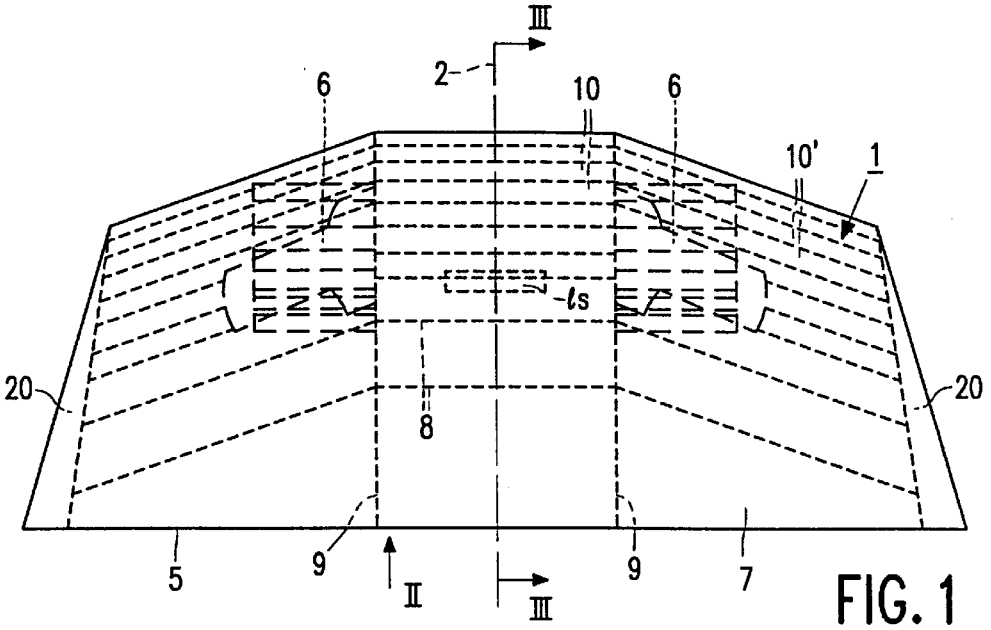

For certain applications, for example if also a field portion immediately below the lamp is to be illuminated, the facet tangent to the light emission window in the plane of symmetry may be tilted outwards from the parabola along the light emission window so that it has come to be, for example, perpendicular to the light emission window.

It is favorable for the creation of a comparatively wide beam transverse to the plane of symmetry when the reflector has no more than three rows of facets.

The second substantially flat planes may enclose an angle with the plane of symmetry. It is favorable, however, for the light distribution in the beam when they are substantially parallel thereto. The reflector then has a substantially equal cross-section wherever this cross-section may be taken parallel to the plane of symmetry.

To obtain a wide beam, facets of rows adjoining facets of a first row which intersects the plane of symmetry enclose an angle of 35 to 45°, for example 40.5°, with the facets of the first row.

The light emission window may be closed off with a flat transparent plate, for example for preventing pollution of the reflector or for repelling vapors, for example moisture, from entering the luminaire. The plate may have an anti-reflection coating for obtaining a high direct transmission of the obliquely incident light.

A few slats may extend from the light emission window into the luminaire along each of the side panels, substantially parallel to the plane of symmetry. Such slats would then be absent in a central portion of the light emission window, around the plane of symmetry. Said slats may be desirable for giving a lamp accommodated in the luminaire a stronger screening in directions transverse to the plane of symmetry. A luminaire with a substantially boat-shaped reflector provided with such slats in this arrangement is known from U.S. Pat. No. 5,564,820.

The reflector, which may be a mirror reflector and may be made, for example, from anodized aluminum, may be accommodated in a housing together with the screen, the side panels, and the means for accommodating a lamp, or may itself constitute a housing with said parts. It is favorable in general when the reflector has openings through which a lamp can be inserted into means for accommodating a lamp which are situated outside the reflector. The means for accommodating a lamp are capable of holding the lamp mechanically only, or capable of connecting it also electrically to a supply source. The reflector may be divided, for example in a plane perpendicular to the plane of symmetry, close to the optical center to render possible the provision of a lamp by a way other than through the light emission window.

The lamp to be accommodated in the luminaire may be, for example, an incandescent lamp, for example a halogen incandescent lamp with a tubular lamp vessel, for example a lamp having a lamp cap at one or both ends. The lamp may alternatively be a discharge lamp, for example a low-pressure or high-pressure discharge lamp, for example a metal halide or sodium vapor discharge lamp. The lamp may have a glass, for example quartz glass, or a ceramic lamp vessel and may or may not be enclosed in an outer envelope The light source of the lamp, i.e. the incandescent body or the discharge arc in a transparent lamp vessel, or the light-emitting portion of a non-transparent, for example ceramic lamp vessel, may have a comparatively great length and a comparatively great diameter while nevertheless the beam properties of the luminaire are retained.

The luminaire may be used inter alia for illuminating a ground surface, for example a sports ground, for illuminating a facade of a building, in which case the light emission window is placed vertically, for illuminating road tunnels, in which case the luminaire may radiate against the driving direction so that a high luminance of the road surface is obtained, for illuminating pedestrian crossings, and for illuminating a region under a canopy, for example of a filling station, in which case the luminaire is, for example, recessed into the canopy. In the latter application, where traffic may drive under the luminaire transversely to the plane of symmetry, it may be desirable to provide slats in the luminaire.

Figure 4:
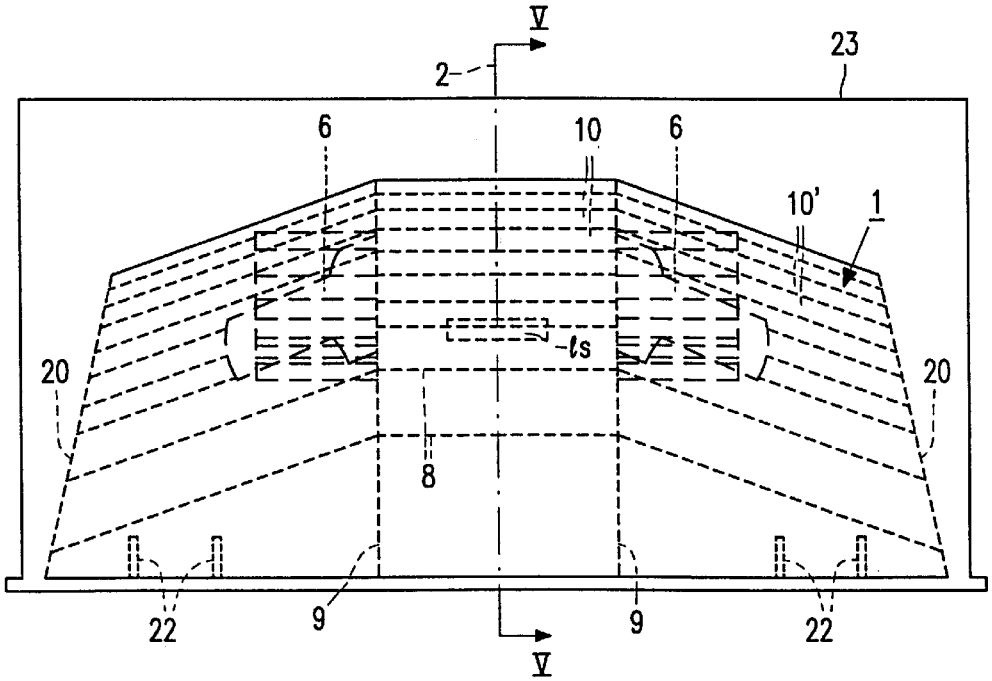
Figure 2:
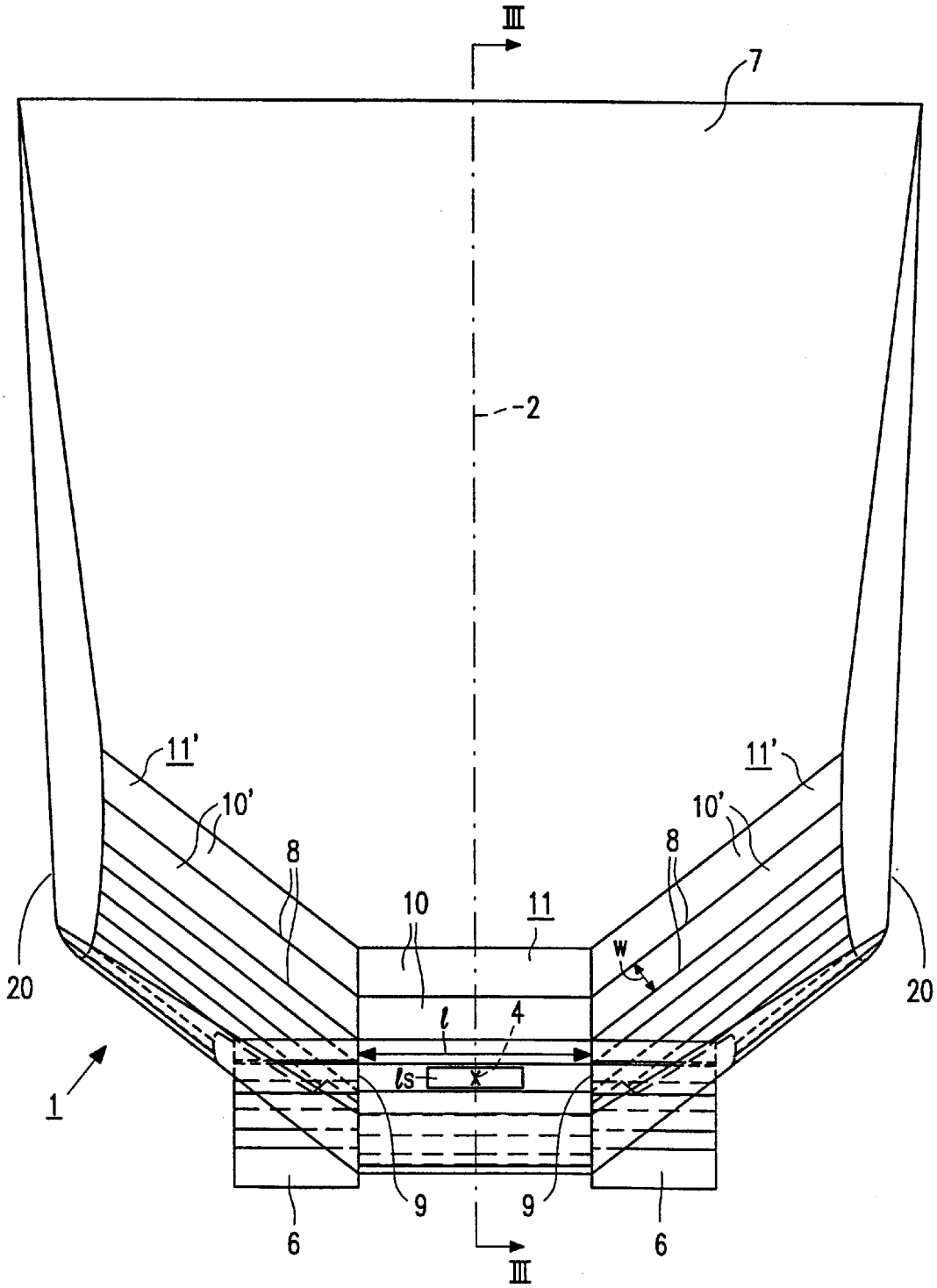
Figure 3:
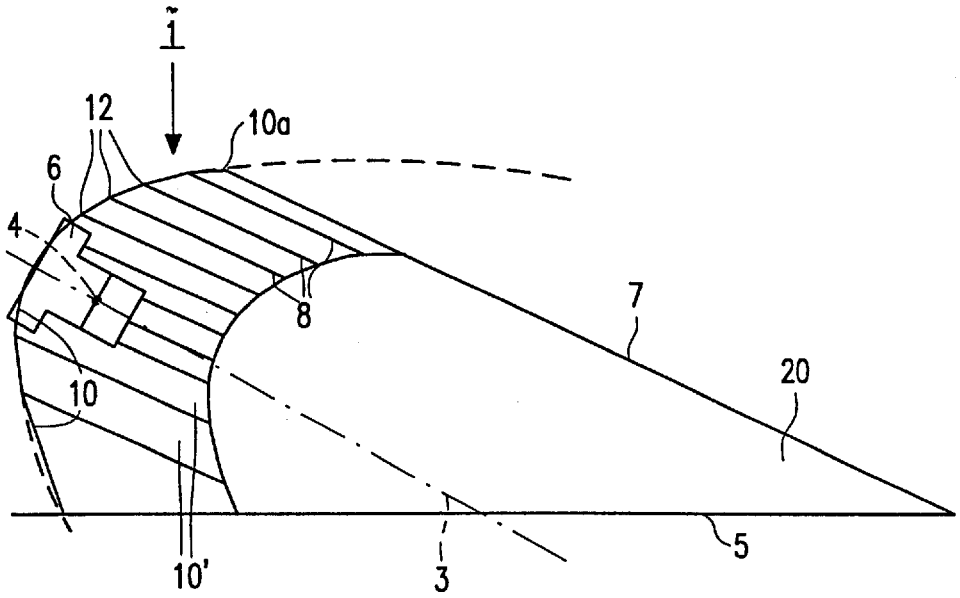

Embodiments of the luminaire according to the invention are shown in the drawing, in which:

FIG. 1 shows a first embodiment in elevation;

FIG. 2 shows the luminaire viewed along II in FIG. 1;

FIG. 3 is a cross-section taken on the line III—III in FIGS. 1 and 2;

FIG. 4 shows a second embodiment in the same way as FIG. 1; and

Figure 5:
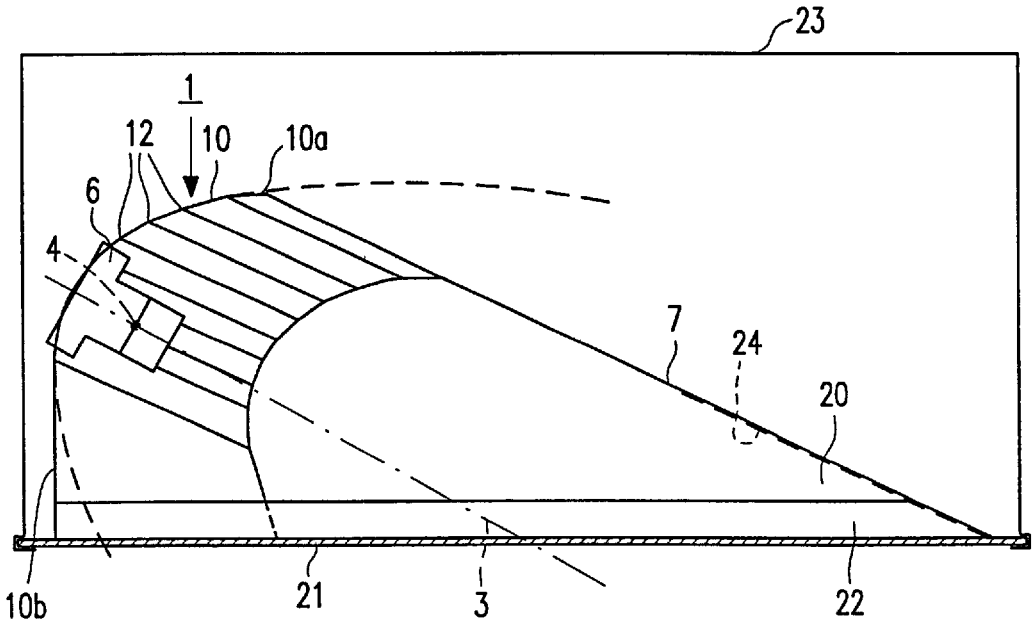

FIG. 5 is a cross-section taken on the line V—V in FIG. 4.

In FIGS. 1 to 3, the luminaire has a concave reflector 1 with a plane of symmetry 2 and an optical axis 3 with an optical center 4 lying in the plane 2. The luminaire has a light emission window 5 tangent to the reflector 1 and transverse to the plane of symmetry 2. A holder 6 is present for accommodating an electric lamp transverse to the plane of symmetry 2 such that an elongate light source is thereof lies in the optical center 4. The holder 6 partly projects through openings in the reflector 1 to the exterior. A light-reflecting screen 7 extends along the optical axis 3, transversely to the plane of symmetry 2, and reaches up to the light emission window 5.

The reflector 1 has several flat facets 10, 10' which are bounded in their widths w by first, mutually substantially parallel flat planes 8 perpendicular to the plane of symmetry and which are also bounded in their lengths 1 by second flat planes 9 which arrange the facets into rows 11, 11' which extend along the plane of symmetry.

The first substantially flat planes 8 enclose a sharp angle, 25° in the Figures, with the light emission window 5, while the screen 7 extends from the reflector 1 up to the light emission window 5.

Side panels 20 merge into the screen 7 on either side of the plane of symmetry 2, extending up to in the light emission window 5 and bounding facets 10' of remote rows 11' which are farthest removed from the plane of symmetry 2.

The screen 7 and the side panels 20 are diffusely reflecting, for example being frosted.

The side panels 20 approach one another in a direction towards the screen 7, enclosing an angle of 75–80° with the light emission window in doing this.

The first flat planes 8 have points of intersection 12 with the reflector 1 in the plane of symmetry 2, which points of intersection lie substantially on a parabola whose focus is the optical center 4.

The screen 7 and the optical axis 3 diverge by an angle of a few degrees, 5° in the Figures, in a direction towards the light emission window. The screen 7 is at least, substantially parallel to the first flat planes 8.

The reflector 1 has facets 10, see FIG. 3, with a greater width w at a side of the optical axis 3 remote from the screen 7 than at a side of the axis 3 adjacent the screen 7.

The facet 10*a* which lies closest to the screen 7 in the plane of symmetry is tilted inwards into the parabola along this screen 7.

The reflector 1 as shown has three rows 11, 11' of facets 10, 10'.

The second substantially flat planes 9 are substantially parallel to the plane of symmetry 2.

Facets 10 of a first row 11 which intersects the plane of symmetry 2 enclose an angle of 35 to 45° with the facets 10' of the adjoining rows 11', in the Figures an angle of 40.5°, measured in a first flat plane 8.

The side panels 20 approach the reflector 1 in the light emission window 5 at an angle of 6° to one another.

In FIGS. 4 and 5, components corresponding to components of the preceding Figures have been given the same reference numerals.

The facet 10*b* tangent to the light emission window 5 in the plane of symmetry 2 is tilted outwards from the parabola along said window 5. This facet 10*b* is perpendicular to the light emission window 5 in these Figures.

The light emission window 5 is closed off with a transparent plate 21, and a few slats 22 extend from the light emission window 5 into the luminaire along each of the side panels 20, substantially parallel to the plane of symmetry 2. These slats are at such a distance from one another and extend so far away from the light emission window that they provide a cut-off angle of 30° with respect to the plane of the closing plate 21. The side panels 20 are mutually parallel in the light emission window 5.

The portion of the screen 7 adjacent the light emission window 5 has been given a white coating 24.

The luminaire of FIGS. 4 and 5 has a housing 23 and can be mounted recessed in a false ceiling.

What is claimed is:

1. A luminaire comprising:

a concave reflector (1) with a plane of symmetry (2) and an optical axis (3) having an optical center (4) lying in said plane (2);

a planar light emission window (5) tangent to the reflector (1) and transverse to the plane of symmetry (2);

means (6) for accommodating an electric lamp transversely to the plane of symmetry (2), with an elongate light source of said lamp in the optical center (4);

a planar light-reflecting screen (7) extending along the optical axis (3) transverse to the plane of symmetry (2);

said reflector (1) comprising several plane facets (10,10') bounded by first, mutually substantially parallel, substantially flat planes (8) perpendicular, to the plane of symmetry (2), and having lengths bounded by second substantially flat planes (9) which arrange the facets into rows (11,11') which extend along the plane of symmetry(2);

wherein: the first substantially flat planes (8) enclose an angle of 15°–30° with the light emission window (5), and the screen (7) extends from the reflector (1) to the light emission window (5).

2. A luminaire as claimed in claim 1, characterized in that side panels (20) extend up to the screen (7) on either side of the plane of symmetry (2), which panels extend up to in the light emission window (5) and bound facets (10') of remote rows (11'), which rows (11') lie farthest removed from the plane of symmetry (2).

3. A luminaire as claimed in claim 2, wherein the screen (7) and the side panels (20) are diffusely reflecting.

4. A luminaire as claimed in claim 2, wherein the side panels (20) approach one another in a direction towards the screen (7).

5. A luminaire as claimed in claim 1, characterized in that the first substantially flat planes (8) have points of intersection (12) with the reflector (1) in the plane of symmetry (2) which lie substantially on a parabola whose focus is the optical center (4).

6. A luminaire as claimed in claim 1, characterized in that the reflector (1) has facets (10) with a greater width w at a side of the optical axis (3) remote from the screen (7) than at a side of this axis (3) adjacent the screen (7).

7. A luminaire as claimed in claim 5, characterized in that the facet (10*a*) lying closest to the screen (7) in the plane of symmetry (2) is tilted inwards into the parabola along this screen (7).

8. A luminaire as claimed in claim 5, characterized in that the facet (10*b*) tangent to the light emission window (5) in the plane of symmetry (2) may be tilted outwards from the parabola along the light emission window (5).

9. A luminaire as claimed in claim 5, characterized in that the screen (7) and the optical axis (3) diverge by an angle of a few degrees in a direction towards the light emission window (5).

10. A luminaire as claimed in claim 1, characterized in that the reflector (1) has no more than three rows (11, 11') of facets (10, 10').

11. A luminaire as claimed in claim 1, characterized in that the second substantially flat planes (9) are substantially parallel to the plane of symmetry (2).

12. A luminaire as claimed in claim 1, characterized in that the facets (10) of a first row (11) intersect the plane of symmetry (2) and, measured in a first flat plane (8), enclose an angle of 35 to 45° with the facets (10') of adjoining rows (11').

13. A luminaire as claimed in claim 1, characterized in that the screen (7) is at least substantially parallel to the first substantially flat planes (8).

14. A luminaire as claimed in claim 1, characterized in that the light emission window (5) is closed off by a transparent plate (21).

15. A luminaire as claimed in claim 2, characterized in that the light emission window (5) is closed off by a transparent plate (21), and in that a few slats (22) extend from the light emission window (5) into the luminaire along each of the side panels (20), substantially parallel to the plane of symmetry (2).

16. A luminaire as in claim 1, wherein said first flat planes enclose an angle of 25° with the light emission window.

* * * * *